US008581727B1

(12) United States Patent
Koenig et al.

(10) Patent No.: US 8,581,727 B1
(45) Date of Patent: Nov. 12, 2013

(54) MISPLACED GOLF CLUB ALERT SYSTEM

(76) Inventors: Jesse Daniel Koenig, San Diego, CA (US); Matthew Charles Smiley, San Diego, CA (US)

( * ) Notice: Subject to any disclaimer, the term of this patent is extended or adjusted under 35 U.S.C. 154(b) by 432 days.

(21) Appl. No.: 12/943,926

(22) Filed: Nov. 10, 2010

Related U.S. Application Data

(60) Provisional application No. 61/259,645, filed on Nov. 10, 2009.

(51) Int. Cl.
*G08B 13/14* (2006.01)

(52) U.S. Cl.
USPC ..... 340/568.6; 340/10.31

(58) Field of Classification Search
USPC ..... 340/568.6, 10.31, 571; 206/315.2
See application file for complete search history.

(56) References Cited

U.S. PATENT DOCUMENTS

| | | | | |
|---|---|---|---|---|
| 4,042,918 | A | 8/1977 | Klitzman | |
| 4,489,314 | A | 12/1984 | Miller | |
| 4,822,052 | A | 4/1989 | Dimmick | |
| 5,565,845 | A | 10/1996 | Hara | |
| 5,782,443 | A | 7/1998 | La Fontaine | |
| 5,844,483 | A | 12/1998 | Boley | |
| 5,952,921 | A | 9/1999 | Donnelly | |
| 5,973,596 | A | 10/1999 | French | |
| 6,023,225 | A | 2/2000 | Boley | |
| 6,057,762 | A | 5/2000 | Dusza | |
| 6,118,376 | A | 9/2000 | Regester | |
| 6,331,817 | B1 | 12/2001 | Goldberg | |
| 6,366,205 | B1 | 4/2002 | Sutphen | |
| 6,377,175 | B1 | 4/2002 | Williams | |
| 6,407,667 | B1 | 6/2002 | Jackson | |
| 6,411,211 | B1 | 6/2002 | Boley | |
| 6,753,778 | B2 | 6/2004 | Kruger | |
| 6,774,792 | B1 | 8/2004 | Williams | |
| 6,788,199 | B2 | 9/2004 | Crabtree | |
| 6,967,563 | B2 * | 11/2005 | Bormaster | 340/10.31 |
| 7,004,848 | B2 | 2/2006 | Konow | |
| 7,106,195 | B2 | 9/2006 | Keays | |
| 7,134,302 | B2 | 11/2006 | Gorst | |
| 7,148,801 | B2 | 12/2006 | Crabtree | |
| 7,205,894 | B1 | 4/2007 | Savage | |
| 7,605,705 | B2 | 10/2009 | Kritt | |
| 8,226,495 | B2 * | 7/2012 | Savarese et al. | 340/568.6 |
| 8,299,921 | B2 * | 10/2012 | LaSala | 340/568.6 |
| 2006/0255918 | A1 | 11/2006 | Bernstein | |
| 2007/0191126 | A1 | 8/2007 | Mandracken | |
| 2009/0233735 | A1 | 9/2009 | Savarese | |
| 2012/0249330 | A1 * | 10/2012 | Savarese et al. | 340/568.6 |

* cited by examiner

*Primary Examiner* — John A Tweel, Jr.

(57) ABSTRACT

Apparatuses, methods, and systems for alerting a golfer when one or more golf clubs are misplaced from a group of golf clubs. A peripheral unit is associated with and affixed to each of a number of golf clubs, and transmits signals that are detected and collectively processed by a base unit to determine the status of those clubs. A club may be designated as misplaced based on the sequence and timing of status events, upon which an alarm is activated to alert the golfer.

18 Claims, 5 Drawing Sheets

MISPLACED GOLF CLUB ALERT SYSTEM

CROSS REFERENCE TO RELATED APPLICATIONS

This application claims priority of U.S. Provisional Patent Application Ser. No. 61/259,645 filed Nov. 10, 2009. Priority of the aforementioned filing date is hereby claimed and the disclosure of the Provisional patent application is hereby incorporated by reference in its entirety.

BACKGROUND OF INVENTION

I. Field of the Invention

The present disclosure relates to a system of devices that acts to alert the user that an item has been misplaced. In particular, the present disclosure relates to alerting a golfer that a golf club has been misplaced. In the context herein, it should be understood that a misplaced golf club is a golf club that has been lost, accidentally left behind, forgotten, or otherwise not returned to the golf bag or to close proximity to the golf bag due to circumstances other than the use of the golf club as part of normal golf play.

II. Description of Related Art

There are several known approaches to solving the problem of misplaced golf clubs. However, shortcomings are apparent in each of the systems disclosed in the past. U.S. Pat. No. 6,366,205 describes a system comprising sensors associated with golf clubs and an interrogator operative to obtain an inventory of golf clubs present in a golf bag and a controller operative to detect the absence from an inventory of a club that was present in a previous inventory. The absent club is treated by this system as "missing", and the system responds by activating an alarm. However, in the vast majority of cases in practice, the absent club would actually be in use by the golfer, not misplaced, creating a constant annoyance to the user as the alarm was activated each time a club was used as part of normal play.

U.S. Pat. Nos. 4,042,918, 4,489,314, 5,565,845, 6,377,175 and 6,774,792 require that an apparatus be fitted to the top of a golf bag or inside a golf bag, with individual holes or tubes, one for each golf club, each hole or tube containing an electromechanical switch or other sensor to detect the presence of a golf club. This apparatus would be bulky and require myriad versions to fit the myriad different shapes and sizes of golf bags, making such prior art examples quite expensive and cumbersome to the user. Furthermore, it would be inconvenient for the golfer to be required to carefully place a golf club in a fitted hole or tube within the bag.

U.S. Pat. Nos. 4,042,918, 6,366,205, 6,411,211 and 7,605,705 include methods that do not detect when a club has been actually misplaced, nor activate an alarm appropriately, instead just activating an alarm whenever a club is removed from the bag, which could cause a constant annoyance to the user as clubs are removed during normal play.

U.S. Pat. Nos. 5,952,921, 6,057,762 and 6,118,376 comprise devices attached to golf clubs wherein the devices transmit, reflect, or in some way emit radio-frequency (RF) signals, and further comprise an RF receiver attached to the golf bag, with an alarm that is activated if an emitting device is beyond a certain threshold distance from the receiver. This method implies that the emitting device must be in RF contact with the receiver during all normal play and should be out of RF contact only in the case of a lost or misplaced place. Clubs may be more than 100 yards away from the receiver during normal play (whether the receiver is attached to the golf bag or carried by the golfer). Therefore, the emitting device must be able to transmit a signal continuously to the receiver over distances greater than 100 yards. This is problematic because it requires a relatively high-power emitting device, and thus the device is relatively expensive and requires relatively large batteries, which would have relatively short life. Also, additional problems could arise if there were any trees, buildings, hills, or other obstacles between the club and the receiver as would often occur during normal play, in which case the RF link would be broken and the alarm would activate, erroneously indicating a misplaced club.

U.S. Pat. No. 5,782,443 is a mechanical device meant to enable a golfer to put down a golf club in such a way that it is held vertically so that it will be easily visible and thus will supposedly not be lost or misplaced. Such devices are cumbersome for the golfer to carry and disrupt normal play to some degree. Also, the golfer must remember to carry the device whenever he will have occasion to place a club down on the ground, which largely defeats the purpose of a lost club prevention system—to alleviate problems caused by forgetfulness.

U.S. Pat. No. 6,407,667 includes an RF transmitter not attached to a golf club, but contained in a separate device upon which a golf club is meant to be rested when it is placed down on the ground. It communicates via RF with a receiver that is meant to be carried on the golfer's person, and an alarm is activated if the distance between the receiver and transmitter exceeds a certain threshold distance. This type of system is cumbersome because it requires the golfer to carry extra devices; it is disruptive to the normal style of play; and since it requires the golfer to remember to use the device whenever he places a club down on the ground, it largely defeats the purpose of a lost club prevention system—to alleviate problems caused by forgetfulness.

U.S. Pat. No. 7,205,894 requires that a belt or some other apparatus be wrapped around the golf bag. This will be undesirable to the golfer because such an apparatus will be unsightly and will likely impede access to and desired use of the pockets, handles, and carrying straps of the golf bag.

Accordingly, there is a need for a system that reliably alerts the golfer when a club has been misplaced (as opposed to alerting the golfer that a club is in use), does not utilize a large amount of energy, and does not disrupt the golfer's normal style and method of play.

All references cited herein are incorporated herein by reference in their entireties.

SUMMARY OF THE INVENTION

The present invention is a system for alerting a golfer when one or more golf clubs are misplaced from a group of golf clubs comprising a peripheral unit associated with each golf club of the group of clubs, a base unit in communication with each peripheral unit and an alarm that alerts the golfer when a golf club has been misplaced.

In one aspect of the present invention a system for alerting a golfer when one or more golf clubs are misplaced from a group of golf clubs is disclosed comprising a peripheral unit associated with each golf club and a base unit with an alarm. Each peripheral unit may have a limited range and may be operative to transmit and detect signals throughout that limited range. The peripheral unit may also comprise a memory operative to store a unique identifier that it transmits periodically or when requested by the base unit.

The base unit may have a similar limited range and may be operative to transmit and detect signals from each peripheral unit throughout that limited range. It may also comprise a memory operative to store one or more unique identifiers transmitted by the one or more peripheral units and a processor operative to perform periodic inventories of the group of golf clubs wherein the periodicity is controlled by a polling timer, compare the most recent inventory with the previous inventory to determine which golf clubs have been recently removed from the group of golf clubs or returned to the group of golf clubs, initiate a removal timer when a golf club is removed from the group of golf clubs, and initiate a return timer when a golf club is returned to the group of golf clubs.

The system identifies a golf club as absent from the group of golf clubs when the peripheral unit of the golf club is outside the limited range and thus its associated unique identifier is not received by the base unit. An absent golf club is determined to be misplaced if and when the removal timer and the return timer have expired. When the absent golf club is determined to be misplaced an alarm is initiated to alert the golfer.

In one embodiment of this aspect of the invention, the system is operative by an electrical power source, such as by a battery or one or more photo-voltaic cells. In addition, the electrical power source may be activated by a light sensor and/or a motion sensor.

In another embodiment, the base unit processor is further operative to initiate a maximum duration timer for each golf club removed from the group of golf clubs wherein expiration of the maximum duration timer initiates the alarm.

In yet another embodiment, the system further comprises a display screen such as a liquid crystal or an organic light-emitting diode display screen. The display screen may be operative to indicate the number of golf clubs in the group of golf clubs or absent from the group of golf clubs, the remaining battery charge of the base unit, and/or the remaining battery charge of the peripheral unit associated with each golf club. In addition, the system may further comprise a keypad operative to adjust the removal timer, the return timer, the polling timer and/or the maximum duration timer.

In still another embodiment, the peripheral unit is affixed to the end of the handle of each golf club of the group of golf clubs. In addition, the peripheral unit may further comprise an alerting means, such as a light emitting diode, for alerting the user that the remaining charge of the battery is low.

In another aspect of the invention, a method is disclosed for detecting one or more misplaced golf clubs from a group of golf clubs comprising: periodically inventorying golf clubs in the group of golf clubs, whereby a unique identifier response is transmitted from a peripheral unit associated with each golf club; storing the unique identifier received from each peripheral unit in a memory; comparing the unique identifier received from each golf club during the most recent inventory to the unique identifier received from each golf club during the previous inventory to determine which golf clubs have been recently removed from the group of golf clubs or returned to the group of golf clubs; monitoring a golf club that is absent from an inventory of golf clubs to determine if the absent golf club has been misplaced wherein the absent golf club is determined to be misplaced when a removal timer and a return timer have expired; and initiating an alert if one or more of the golf clubs are determined to be misplaced.

Numerous other advantages and features of the described embodiments will become readily apparent from the detailed description of preferred embodiments of the invention, from the claims and from accompanying drawings in which like numerals are employed to designate like parts throughout the same.

DETAILED DESCRIPTION OF THE INVENTION

Figure 1:
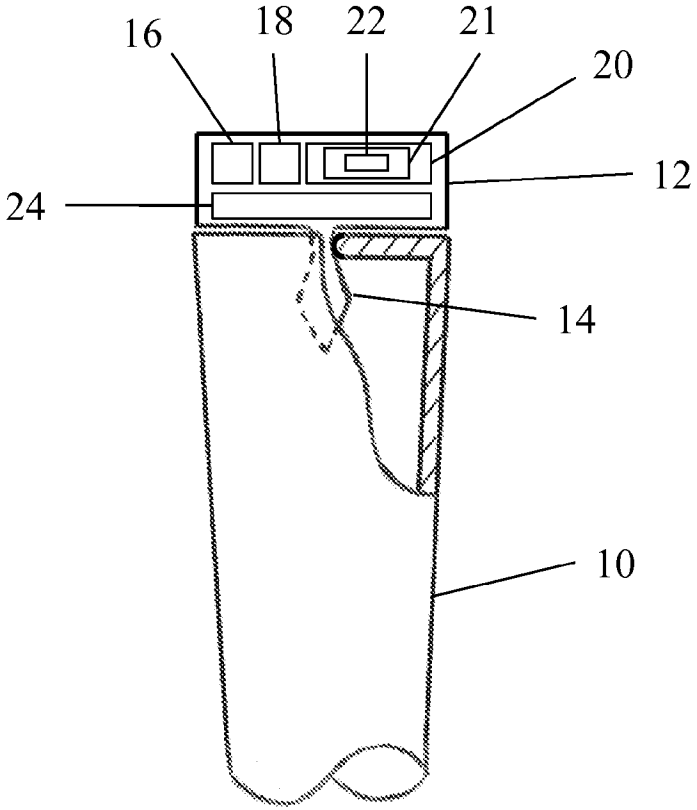
FIG. 1 is a partial cross-sectional view of the end of the grip portion of a golf club, showing the Peripheral Unit affixed within the hole at the end of the grip, where the Peripheral Unit comprises a radio frequency (RF) transmitter and receiver, a microprocessor, and a battery.

During a game of golf, a golfer will often remove more than one club from his golf bag, especially when his golf ball is close to the putting green. The clubs removed usually include one or more wedge clubs, as well as the putter club. After the golfer uses the wedge club(s) to hit the ball onto the green, the wedge club(s) is often placed on the ground while the golfer uses the putter club on the green. Sometimes, after putting, the golfer forgets to retrieve the wedge club(s) that he has left on the ground. The missing club(s) can go unnoticed for several holes, causing significant inconvenience, or can be lost entirely, causing both inconvenience and undesired monetary expenditure.

The present invention is a system for alerting a golfer when one or more golf clubs are misplaced from a group of golf clubs comprising a peripheral unit associated with each golf club of the group of clubs, a base unit in communication with each peripheral unit and an alarm that alerts the golfer when a golf club has been misplaced. The peripheral unit associated with each golf club is operative to transmit and detect signals throughout a limited range and a memory operative to store and transmit a unique identifier. The base unit, generally associated with a golf bag, is operative to transmit and detect signals from each peripheral unit throughout a limited range, a memory operative to store one or more unique identifiers transmitted by the one or more peripheral units and a processor operative to perform an initial inventory of the group of golf clubs, store the initial inventory in the memory, initiate a removal timer for each club removed from the golf bag, initiate a return timer for each club to be returned to the golf bag, initiate a polling timer to periodically perform subsequent inventories of the group of golf clubs and compare the subsequent inventories to the initial inventory. A golf club is identified as absent when the peripheral unit of the golf club is outside the limited range and its associated unique identifier is not received by the base unit. An absent club is determined to be misplaced when the removal timer and the return timer have expired. When a golf club has been determined to be misplaced an alarm operative to alert the golfer is initiated.

The system alerts a golfer after a relatively short period of time, for example before he proceeds to the next hole of the golf course that he has misplaced or left behind one or more golf clubs. In the context herein, it should be understood that a misplaced golf club is a golf club that has been lost, accidentally left behind, forgotten, or otherwise not returned to the golf bag or to close proximity to the golf bag due to circumstances other than the use of the golf club as part of normal golf play.

Other features and advantages will be apparent from the following description of various embodiments, which illustrate, by way of example, the principles of the disclosed systems, devices, and methods.

While the disclosed systems, devices, and methods are described with respect to golf clubs, the systems, devices, and methods may be adapted to be used in various applications known in the art. It should be understood that it is within the broadest scope of the present invention to cover any systems that rely upon the devices and methods described herein to alert a user that any type of item has been misplaced from its normal storage place.

The present disclosure is of a system that comprises a plurality of first devices attached to a plurality of golf clubs; these first devices shall be referred to hereinafter as "Peripheral Units". The system of the present disclosure further comprises a second device attached to, inherent to, embedded in, or otherwise associated with a golf bag; this second device shall be referred to hereinafter as a "Base Unit". The principles of operation of this system indicate that a minimum of two Peripheral Units are included in the system.

I. Peripheral Unit

In one embodiment, each Peripheral Unit is attached to a golf club, and a single Peripheral Unit is attached to each golf club that is to be protected from loss. Furthermore, the principles of operation of this system indicate that a Peripheral Unit is attached to each golf club that may be commonly removed from the golf bag simultaneous to the removal of a different club that is to be protected from loss. For example, if a wedge club is to be protected from loss, a Peripheral Unit should be attached to that wedge club, and since the putter club is commonly removed from the golf bag simultaneous to the removal of the wedge club, a Peripheral Unit should be attached to that putter club as well. Each club with a Peripheral Unit will be accorded the same protection from loss, so in the example cited above, the putter club will automatically receive protection from loss just as the wedge club will. There exists no intrinsic upper limit to the number of Peripheral Units in use within the system, as long as each Peripheral Unit is attached to a separate golf club to be stored in a golf bag associated with the Base Unit.

One embodiment of the Peripheral Unit 12 is illustrated in FIG. 1, which also shows an exemplary manner of attachment of a Peripheral Unit 12 to a golf club. In the embodiment, the body of the Peripheral Unit 12 includes a piece 14 that is pushed, screwed, or otherwise inserted into the hole that is typically found at the end of the grip portion 10 of a typical golf club.

The body of the Peripheral Unit 12 includes an enclosure containing a Processing Segment 20, a radio-frequency (RF) transmitter 16 (e.g. an LC resonant tank circuit), an RF receiver 18 (e.g. an Analog Front End, AFE), an internal or external antenna, and an electrical power source such as a battery 24 (e.g. a CR1632 battery). The components in the Peripheral Unit 12 are connected to one another by techniques known in the art. The Processing Segment 20 includes a microcontroller 21 (which may be otherwise known as an integrated circuit, a controller, a processor, a microprocessor, or a microcomputer, e.g. an 8-bit microcontroller such as a Microchip PIC16F1827-1/ML), as well as a digital memory device 22 which may be integrated to the microcontroller 21. The Processing Segment 20 performs various processing methods, such as processing incoming and outgoing signals, and may store various information that may be used for these methods. For example, in an embodiment a unique identifier code is associated with each Peripheral Unit 12, and that code is stored in the digital memory device 22 of the Peripheral Unit 12. The code is "unique" in the sense that no two Peripheral Units 12 in a single system contain the same codes.

II. Base Unit

Figure 2:
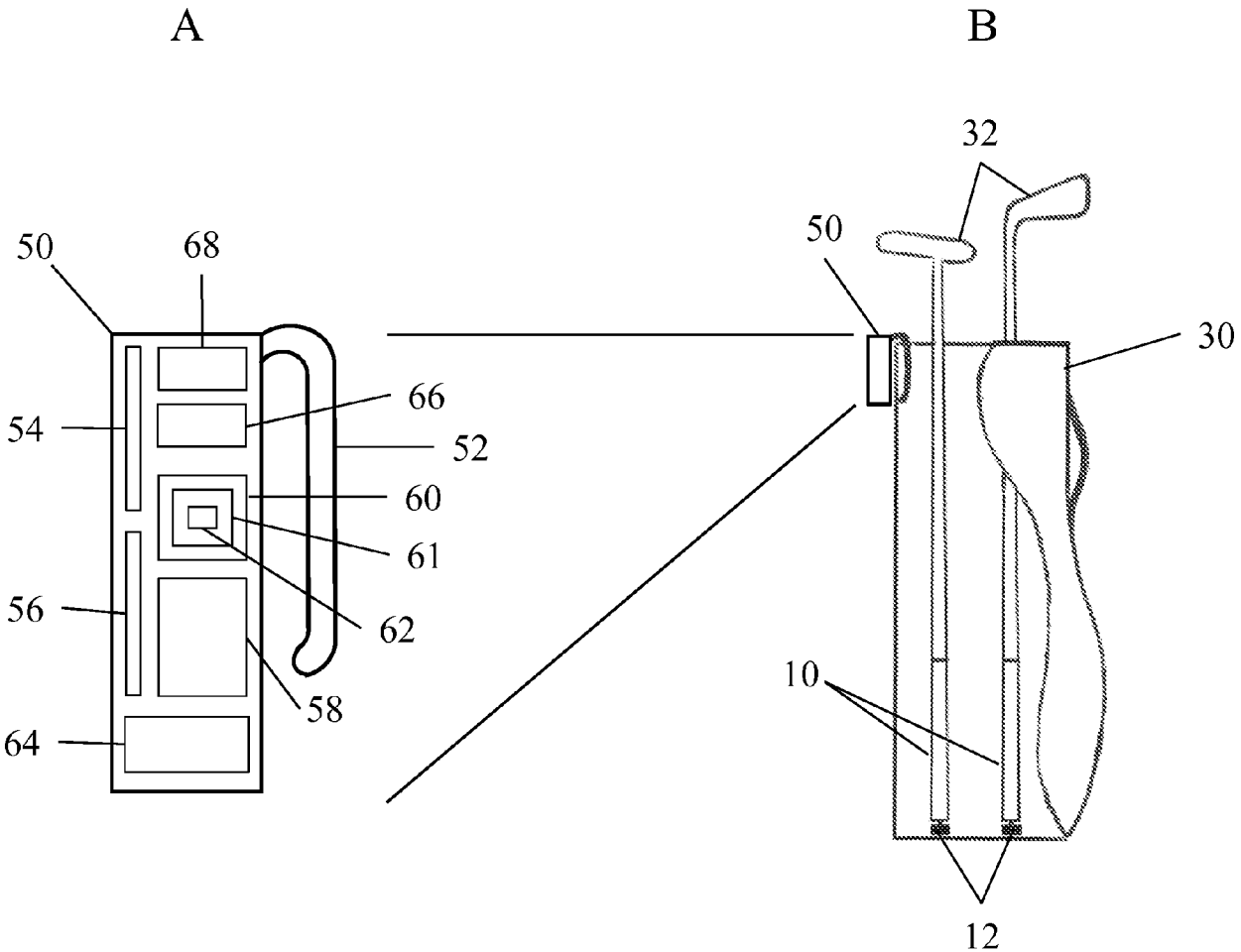
FIG. 2 is a partial cross-sectional view of a golf bag containing two golf clubs, each fitted with a Peripheral Unit of the type shown in FIG. 1 and a Base Unit clipped onto the top of the golf bag.

One embodiment of the Base Unit 50 is illustrated in FIG. 2, which also shows an exemplary manner of attachment of a Base Unit 50 to a golf bag 30. In the embodiment, the body of the Base Unit 50 is similar in size and shape to the size and shape of a pager, and includes a mechanism such as a clip 52 allowing it to be attached to the golf bag 30. FIG. 2 also shows two golf clubs 32 in the golf bag 30, with a Peripheral Unit 12 attached to each.

The body of the Base Unit 50 includes an enclosure containing a Processing Segment 60, an RF transmitter 68 (e.g. an LC resonant tank circuit), an RF receiver 66 (e.g. an AFE), an internal or external antenna, an electrical power source such as a battery 58 (e.g. a 9-volt battery), an alarm mechanism 64 (e.g. a Soberton GT-0930RP2 buzzer), a visual display 54 (e.g. a Crystalfontz CFAL12832C-W-B1 display), a means for user input such as a key pad 56 (e.g. comprising Panasonic EVQ-PNFO4M tactile switches) which may include a switch (e.g. an ALPS SSAC120100 power switch) to power on or power off the Base Unit's electronics. The components in the Base Unit 50 are connected to one another by techniques known in the art. The Processing Segment 60 includes a microcontroller 61 (which may be otherwise known as an integrated circuit, a controller, a processor, a microprocessor, or a microcomputer, e.g. an 8-bit microcontroller such as a PIC16F1827-I/ML), as well as a digital memory device 62 which may be integrated to the microcontroller 61. The Processing Segment 60 performs various processing methods, such as processing incoming and outgoing signals, and may store various information that may be used for these methods.

The alarm mechanism 64 may be any combination of: A) a visible alerting component emitting light, such as a light emitting diode; B) an audible alerting component emitting sound such as beeps, simulated voices, music, or other audible tones; and/or C) a vibrating component causing vibrations that can be perceived by the user.

In an embodiment the memory 62 within the Base Unit 50 is programmed with all of the unique identifier codes associated with all of the Peripheral Units 12 in the system of which the Base Unit 50 is a part. Periodically, with a temporal period of predetermined length, typically some fraction of a minute such as twenty-five seconds, the Base Unit 50 performs a poll of the Peripheral Units 12 to obtain an inventory of the clubs 32 present in the bag 30 or in close proximity to the bag 30. This poll is controlled by the Processing Segment 60 of the Base Unit 50, and is performed by sequentially transmitting RF signals from the transmitter 68 of the Base Unit 50, each signal encoded with one of the unique identifier codes associated with the Peripheral Units 12.

When a first signal transmitted by the Base Unit 50 is received by the receiver 18 of a Peripheral Unit 12, this first signal is processed by the Processing Segment 20 of the Peripheral Unit 12. If the identifier code encoded into this first signal matches the identifier code stored in the digital memory device 22 of the Peripheral Unit 12, the Peripheral Unit 12 transmits a second signal. The second signal is controlled by the Processing Segment 20 of the Peripheral Unit 12 and is encoded with the identifier code of the Peripheral Unit 12 and is transmitted by the transmitter 16 of the Peripheral Unit 12.

Subsequent to sending each signal of a poll, the Base Unit 50 waits a predetermined amount of time, typically some fraction of a second, to receive a signal from the Peripheral Unit 12 with associated identifier code matching the identifier code encoded into the signal sent by the Base Unit 50. If the receiver 66 of the Base Unit 50 does not receive such a signal from that particular Peripheral Unit 12 within the wait time, the Processing Segment 60 of the Base Unit 50 does not count that particular Peripheral Unit 12 nor its associated golf club 32 in the current inventory. However, if the receiver 66 of the Base Unit 50 does receive such a signal from that particular Peripheral Unit 12 within the wait time, the Processing Segment 60 of the Base Unit 50 does count that particular Peripheral Unit 12 and its associated golf club 32 in the current inventory. In this embodiment, the RF communication method may be designed such that the RF signal from a particular Peripheral Unit 12 will be received by the Base Unit 50 only if that particular Peripheral Unit 12 is in close proximity to the Base Unit 50. In the context herein, "close proximity" should be understood to mean within a distance indicating that a golf club 32 is in the golf bag 30, or more generally that a golf club 32 is not in use. For example, close proximity means within approximately 10 feet of the Base Unit 50. In some embodiments, this distance threshold within which the RF signal from a Peripheral Unit 12 will be received by the Base Unit 50 may be greater than 10 feet, for example it may be 15 feet, or the distance threshold may be less than 10 feet, for example it may be 5 feet.

In an embodiment, when the Base Unit 50 receives an RF signal from a particular Peripheral Unit 12, a processing method implemented in the Processing Segment 60 of the Base Unit 50 may ascertain the magnitude (e.g. the voltage) of that signal as it comes from the receiver 66. The Processing Segment 60 of the Base Unit 50 then only counts a Peripheral Unit 12 and its associated golf club 32 in the current inventory if the received magnitude of the signal sent by that Peripheral Unit 12 is above a predetermined threshold, and does not count a Peripheral Unit 12 nor its associated golf club 32 in the current inventory if the received magnitude of the signal sent by that Peripheral Unit 12 is below the predetermined threshold. In this embodiment, the RF communication method may be designed such that the RF signal from a particular Peripheral Unit 12 will be received by the Base Unit 50 even if that particular Peripheral Unit 12 is not in close proximity to the Base Unit 50.

III. Method for Detecting Misplaced Golf Club

In one embodiment, the Processing Segment 60 of the Base Unit 50 receives periodic inputs consisting of an inventory of golf clubs 32 that are currently in the bag 30 or in very close proximity to the bag 30. These inputs are used in a processing method of logic within the Processing Segment 60 of the Base Unit 50 to monitor the sequence and timing of removal and return of the golf clubs 32, and to determine when a club has been misplaced, and to then activate an alarm 64 to notify the golfer. In this embodiment, these inputs include particular identifier codes associated with particular clubs, so that the processing method can distinguish between different clubs.

The processing method compares the most recent inventory to the previous inventory. Any particular club present in the most recent inventory that was absent in the previous inventory is considered by the method to have been returned to the bag 30. Any particular club absent in the most recent inventory that was present in the previous inventory is considered by the method to have been removed from the bag 30. The method is able to employ multiple simultaneous timers of various durations, which may be activated at different times and decremented simultaneously and individually. The method employs a single timer called the Polling Timer that dictates the frequency with which the Peripheral Units 12 and the Base Unit 50 communicate with each other, and thus the frequency with which the Base Unit's method obtains an inventory of golf clubs 32. The duration of the polling timer may be for example 25 seconds. Decreasing the duration of the polling timer would cause more frequent polling, which in some cases would decrease the amount of time within which the system alerts the golfer to a misplaced golf club, but it would also cause the system to consume increased electrical energy.

For each golf club 32 that is being monitored by the Base Unit 50, there is a separate timer within the processing method called a Max Timer. Whenever the processing method determines that a particular club has been removed, the Max Timer associated with that club is reset and activated. If any Max Timer expires, the Base Unit's alarm 64 is activated. This provision of the method ensures that if any golf club is out of close proximity to the golf bag 30 for a time greater than the duration of the Max Timer, the alarm 64 will be activated to notify the golfer. In order to prevent false alarms, the Max Timer has a duration greater than the amount of time that any given club may typically be out of close proximity to the golf bag 30 during normal play when that club has not been misplaced, for example 500 seconds. However, it may be generally desirable to alert the golfer to a misplaced club in an amount of time significantly shorter than the Max Timer, so other provisions are present in the method to achieve this goal, with the Max Timer functionality left as a back-up measure.

The processing method also employs a single timer called the Removal Timer, which has a shorter duration than the Max Timer, for example 30 seconds. Whenever the method determines that any club 32 has been removed from the bag 30, the Removal Timer is reset and activated. If the Removal Timer expires while it is active, then the method considers all clubs that are out of the bag 30 to be in use.

The processing method also employs a single timer called the Return Timer, which has a shorter duration than the Max Timer, for example 30 seconds. Whenever the method determines that any club 32 has been returned to the bag 30, the Return Timer is reset and activated. However, this functionality is blocked if the Removal Timer is active; the Return Timer will not be activated while the Removal Timer is active, and if the Return Timer is active when the Removal Timer is activated, the Return Timer will then be deactivated.

If the Return Timer expires while it is active, and there are at that time one or more clubs in use, the alarm 64 will be activated to notify the golfer that one or more clubs have been misplaced.

In an exemplary scenario, if two clubs A and B are removed from the bag 30 for longer than the duration of the Removal Timer and then at some later time only club A is returned to the bag 30, then when the next inventory is obtained, the Return Timer will be activated, and if it expires while the club B is still not in close proximity to the bag 30, the alarm 64 will be activated.

In another exemplary scenario, if there are two clubs, A and B in use, but then the golfer decides to switch club B for club C, which is in the bag 30, the Return Timer will not be active after the exchange, either because if club C is removed shortly before club B is returned, the Removal Timer activated by club C's removal prevents the Return Timer from activating upon club B's return, or if club B is returned shortly before club C is removed, the Return Timer activated upon club B's return is deactivated by the Removal Timer activated by club C's removal. Thus, as desired, the alarm 64 is not activated in this scenario of normal play.

Also, whenever the Removal Timer expires, the method checks whether that instance of the Removal Timer has deactivated or inhibited a Return Timer. If it has, the method checks whether any clubs are in use that were not in use before the Removal Timer started. If not, the Return Timer is started. Thus, in the exemplary scenario described above, after club B, which is in use, is exchanged for club C, which is in the bag 30, the Return Timer for club B's return is either inhibited or deactivated by the Removal Timer for club C's removal. In this case there is a club (C) in use that was not in use before the Removal Timer started, and so the Return Timer is not started. However, in another scenario wherein there are two clubs, A and B in use, the golfer returns only club A to the bag 30, activating the Return Timer. Before the Return Timer expires, the golfer removes a club from the bag 30, starting the Removal Timer and deactivating the Return Timer, but then returns that same club to the bag 30. Then when the Removal Timer expires, the method will find that the Removal Timer had deactivated a Return Timer, and since there is not a club in use that was not in use before the Removal Timer started, the Return Timer will be started. When that Return Timer expires, the alarm 64 will be activated, as desired, to notify the golfer that Club B has been misplaced.

Figure 5:
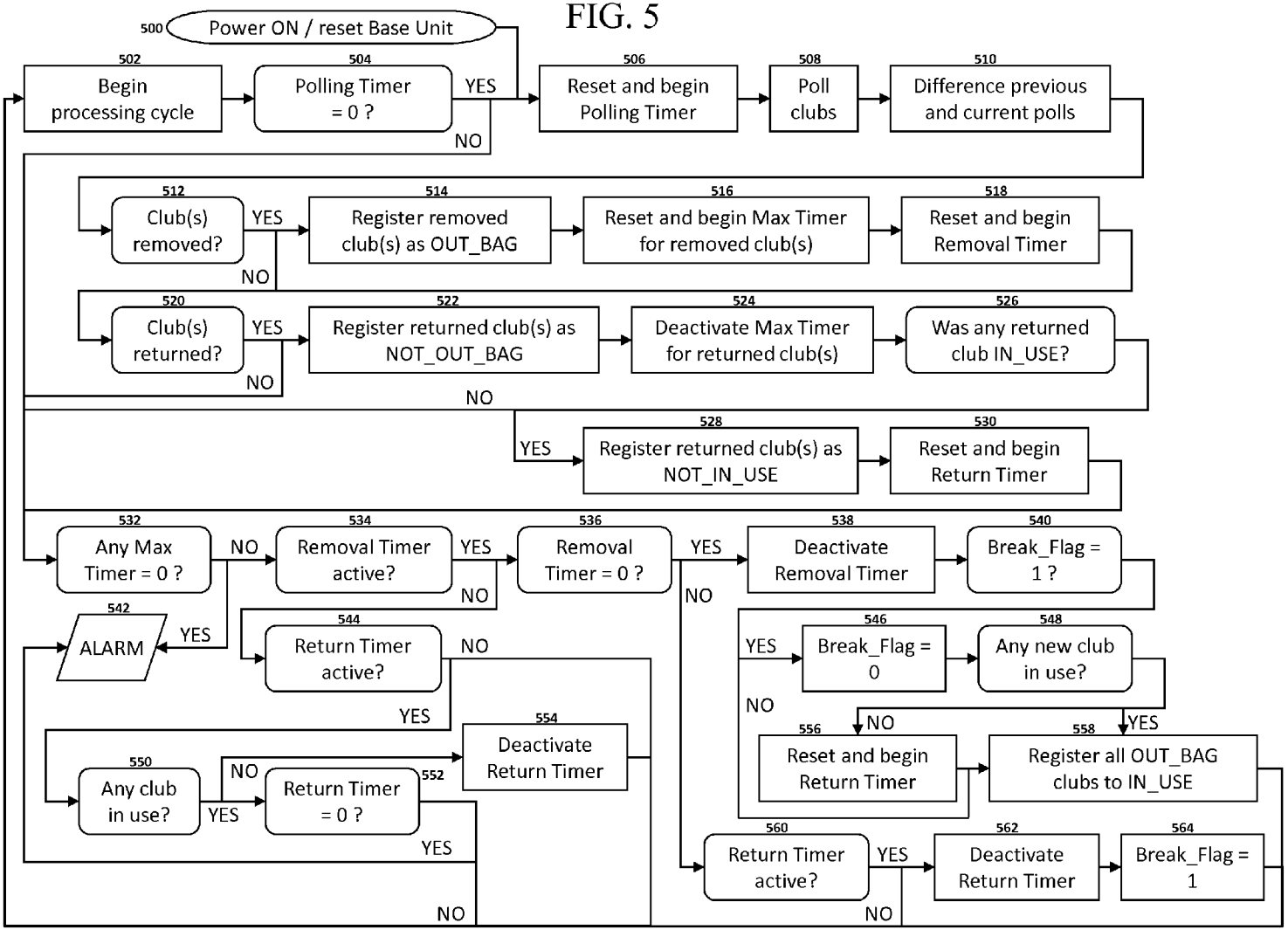
FIG. 5 is a flowchart representing aspects of an exemplary processing method of logic implemented in the Base Unit.

FIG. 5 shows a flow diagram representing an exemplary processing method of logic within the Processing Segment 60 of the Base Unit 50. The processing is performed in discrete cycles, with an entire cycle executed at each time step. For example, an entire cycle may be executed once per second.

When the Base Unit 50 is either powered on or reset in step 500, the method goes to step 506.

At step 502, the Base Unit's method begins its first processing cycle by proceeding to decision step 504.

Timers that may be activated within the method are: the Removal Timer, the Return Timer, and the Max Timer. (The durations of the Removal Timer and the Return Timer may be, for example, 30 seconds each. The duration of the Max Timer is significantly higher than that of the Removal and Return Timers; for example, the duration of the Max Timer may be 500 seconds.) There is actually a separate independent Max Timer for each golf club that is part of the system, i.e. for each club fitted with a Peripheral Unit 12. There is also a timer that is always active: the Polling Timer. (The duration of the Polling Timer should be somewhat lower than that of the Removal and Return Timers; for example, the duration of the Polling Timer may be 25 seconds.)

At decision step 504, if the Polling Timer=0 (i.e. has just expired), the Polling Timer is reset to its full duration in step 506 and resumes counting down, followed by step 508; otherwise the method goes to decision step 532.

In step 508, the clubs are polled via a method of RF communication, such that the Base Unit 50 obtains an inventory of which clubs are currently in the golf bag or in close proximity to the golf bag, and the method progresses to step 510.

In step 510, the method ascertains the difference between the current inventory and the previous inventory. Any club that is missing from the current inventory but was present in the previous inventory is considered to have been removed from the bag between the times of the previous and current polling. Any club that is present in the current inventory but was missing from the previous inventory is considered to have been returned to the bag between the times of the previous and current polling. After step 510 the method progresses to decision step 512.

At decision step 512, if there were one or more clubs removed between the times of the previous and current polling, in step 514 those clubs are registered as having status OUT_BAG, followed by step 516; otherwise the method goes to decision step 520.

In step 516, the Max Timer is set to its full duration and begins counting down, and the method progresses to step 518.

In step 518, the Removal Timer is set to its full duration and begins counting down, and the method progresses to decision step 520.

At decision step 520, if there were one or more clubs returned between the times of the previous and current polling, in step 522 those clubs are registered as having status NOT_OUT_BAG, followed by step 524; otherwise the method goes to decision step 532.

In step 524, the Max Timers for any returned clubs are deactivated, and the method progresses to decision step 526.

At decision step 526, if any of the returned clubs is designated within the method as IN_USE, in step 528 the returned clubs are registered as NOT_IN_USE, followed by step 530; otherwise the method goes to decision step 532.

In step 530, the Return Timer is set to its full duration, and begins counting down, and the method progresses to decision step 532.

At decision step 532, if the Max Timer=0 (i.e. has just expired) for any club, the Base Unit's alarm is activated in step 542 to alert the user that he has misplaced one or more golf clubs; otherwise the method goes to decision step 534.

At decision step 534, if the Removal timer is active, the method goes to decision step 536; otherwise the method goes to decision step 544.

At decision step 536, if the Removal Timer=0 (i.e. has just expired), the Removal Timer is deactivated in step 538, followed by decision step 540; otherwise the method goes to decision step 560.

There is a variable in the method called Break Flag, which can be set to either 0 or 1. At decision step 540, if Break Flag=1, Break Flag is set to 0 in step 546; otherwise the method goes to step 558.

At decision step 548, if any of the clubs designated as OUT_BAG are not already designated as IN_USE (meaning effectively that there are one or more new clubs in use), the method goes to step 558; otherwise in step 556, the Return Timer is set to its full duration and begins counting down, and the method progresses to step 558.

In step 558, all clubs designated as OUT_BAG are registered as IN_USE, and the method is then complete until the start of the next processing cycle.

At decision step 560, if the Return Timer is active, the Return Timer is deactivated in step 562, followed by step 564; otherwise the method is complete until the start of the next processing cycle.

In step 564, Break Flag is set to 1, and the method is then complete until the start of the next processing cycle.

At decision step 544, if the Return Timer is active, the method goes to decision step 550; otherwise the method is complete until the start of the next processing cycle.

At decision step 550, if one or more clubs is designated as IN_USE, the method goes to decision step 552; otherwise the method goes to step 554.

At decision step 552, if the Return Timer=0 (i.e. has just expired), the Base Unit's alarm is activated in step 542 to alert the user that he has misplaced one or more golf clubs; otherwise the method is complete until the start of the next processing cycle.

In step 554, the Return Timer is deactivated, and the method is then complete until the start of the next processing cycle.

IV. Operation

It is important to note that the system of the present disclosure is easy for the user to implement, is not cumbersome to use and does not impede or alter the normal style of golf play.

A typical system may be sold in some type of packaging known in the art. To begin using the system, one removes the system from the packaging. A typical system includes a single Base Unit 50 and a plurality of Peripheral Units 12. For example, a system may include three Peripheral Units 12.

One may insert a battery 58, rechargeable or not, into the Base Unit 50. A typical battery 58 for the Base Unit 50 is a 9-volt battery, but other types of batteries may be used as well. The battery 58 for the Base Unit 50 may be included in the packaging with the system, or may be purchased separately.

One may insert a battery 24, rechargeable or not, into each Peripheral Unit 12. A typical battery for the Peripheral Unit 12 is one of a type known as coin-cell batteries. The batteries for the Peripheral Units 12 may be included in the packaging with the system, or may be purchased separately. The system may be sold with the batteries for the Peripheral Units 12 already in place in the Peripheral Units 12. In this case, there may be a way to activate each Peripheral Units 12 by connecting its battery 24 to its electronics. For example, one may pull out a plastic tab that was theretofore electrically insulating the battery 24 from the electronics of the Peripheral Unit 12. Alternatively, one may twist one part of the Peripheral Unit 12 relative to another part, such that the battery 24 becomes electrically connected to the electronics of the Peripheral Unit 12 where it was not before.

One may then attach the Base Unit 50 to one's golf bag 30 by way of some type of clip 52, hook and loop fasteners, or some other manner known in the art.

One may then attach each Peripheral Unit 12 to a golf club 32 by pushing, screwing, or otherwise inserting a piece 14 of the body of the Peripheral Unit 12 into the hole typically found at the end of the grip portion 10 of a golf club 32. In the unlikely case that there is not a hole at the end of the grip portion 10 of a golf club, a hole may be made with an awl, drill, or some other device commonly available.

One would typically attach the Peripheral Units 12 to wedge clubs, as these clubs are typically left behind on the golf course, as discussed above. For example, one would typically attach a Peripheral Unit 12 to each of the sand wedge and the pitching wedge. Also, one would typically attach a Peripheral Unit 12 to the putter club, because the putter is commonly removed from the golf bag 30 simultaneous to the removal of the wedge clubs, as discussed above.

In one embodiment, when one is ready to begin playing golf, one turns on the power switch of the Base Unit 50 to provide power to the electronics of the Base Unit 50, and thus to cause the system to be ready for use. In another embodiment, the Base Unit 50 includes means to automatically turn itself on.

At this point in the use of the system, no special actions are necessary by the user. A major advantage of this system is that it can be said to be transparent to the user, that is, one does not have to think about the system or alter one's normal mode of golf play in order for the system to function properly.

The system will now monitor the sequence and timing of golf clubs 32 being removed from and returned to the golf bag 30, and will alert the user with an alarm 64 when it detects that a club has been misplaced. The user will thereby be spared annoyance, embarrassment, delay, and cost.

V. Features and Functionality of the Processing Segments

In one embodiment, the Base Unit 50 performs a poll by having its Processing Segment 60 generate a data packet comprising a preamble, an identifier code, a command, and a checksum, which are types of data elements known in the art. That data packet is then used to modulate a carrier frequency, for example a 125 KHz carrier frequency, creating a signal that is then transmitted by the transmitter 68 of the Base Unit 50.

In one embodiment, the Peripheral Unit 12 usually remains in a low-power "listening" mode. To conserve electrical power, when the Peripheral Unit 12 is in listening mode, its microcontroller 21 is in "sleep" mode. In this embodiment, the receiver 18 (e.g. an AFE) draws very little electrical power and remains active while the Peripheral Unit 12 is in listening mode. When the Peripheral Unit 12 receives an RF signal from the Base Unit 50, the AFE detects whether the identifier code encoded into that signal matches the identifier code stored in the memory 22 of the Peripheral Unit 12. If so, the AFE activates the microcontroller 21 of the Peripheral Unit 12, taking it out of sleep mode. Then the AFE passes the demodulated data of the signal to the microcontroller 21 for processing.

In the case that the signal received by the Processing Segment 20 of a Peripheral Unit 12 contains a polling command, that Processing Segment 20 generates a data packet comprising a preamble, the identifier code stored in the memory 22 of the Peripheral Unit 12, a value to indicate the voltage level of the battery 24 in the Peripheral Unit 12, and a checksum. That data packet is then used to modulate a carrier frequency, for example an 8.125 MHz carrier frequency, creating a signal that is then transmitted by the transmitter 16 of the Peripheral Unit 12.

When the receiver 66 of the Base Unit 50 receives such a signal from a Peripheral Unit 12, the signal is amplified, mixed with a Local Oscillator, filtered, demodulated, and presented to the microcontroller 61 of the Base Unit 50 for processing. This processing may include obtaining an inventory of Peripheral Units 12 and associated golf clubs 32 that are in the golf bag 30 or in close proximity to the golf bag 30.

VI. Additional Embodiments and Features of the System

Figure 3:
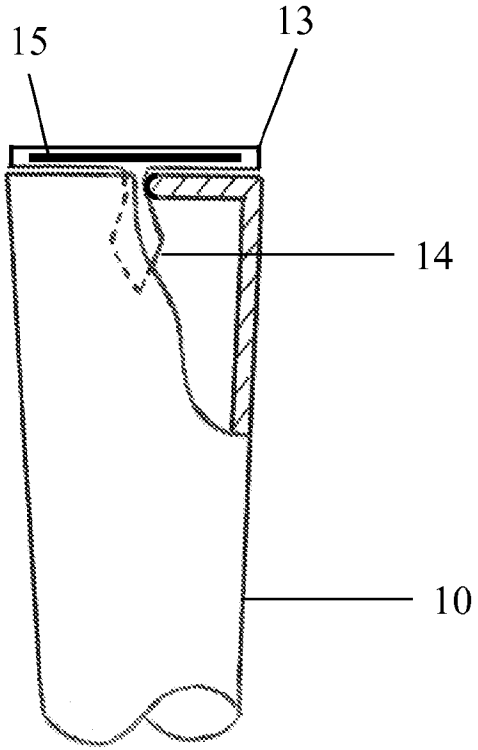
FIG. 3 is a partial cross-sectional view of the end of the grip portion of a golf club, showing the Peripheral unit affixed within the hole in the end of the grip, where the Peripheral Unit comprises a passive radio frequency identification (RFID) tag.
Figure 4:
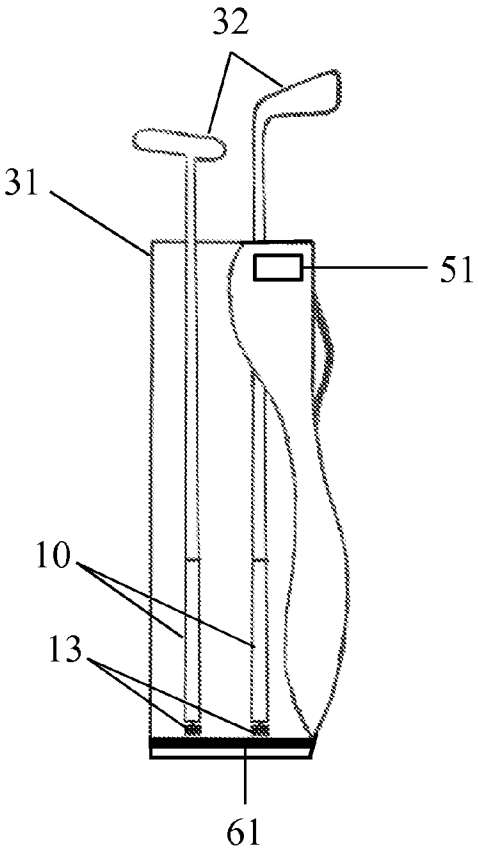
FIG. 4 is a partial cross-sectional view of a golf bag containing two golf clubs, each fitted with a Peripheral Unit of the type shown in FIG. 3, and a built-in RFID-type Base Unit.

In another embodiment, each Peripheral Unit 13 contains a passive radio frequency identification (RFID) tag 15 as shown in FIG. 3. In this embodiment the Peripheral Unit 13 does not contain a Processing Segment or an inherent battery or other power source. In this embodiment the Base Unit 51 contains an RF transmitter and an RF receiver, which taken together and configured to communicate with a passive RFID tag may be called an RFID Reader. In this embodiment, the method of communication between the Base Unit 51 and a Peripheral Unit 13 comprises RF signals transmitted by the Base Unit 51, which when incident upon an RFID tag 15 produce backscatter RF energy, which is modulated by the RFID tag 15 via techniques known in the art, such that the backscatter RF energy forms an RF signal that may be received by the Base Unit 51 if it is in close proximity to the Peripheral Unit 13. The RFID tag 15 includes a digital memory device upon which is stored an identifier code which is included on the signal produced by the RFID tag 15 and received by the Base Unit 51. Thus the Base Unit 51 may use a similar processing method as that described above and shown in FIG. 5 to obtain inventories of golf clubs 32 and detect when one has been misplaced and activate an alarm 64 appropriately. In this embodiment, it is helpful for an RF antenna 61 connected to the RFID Reader to be in very close proximity to the RFID tags of the Peripheral Units 13 when the golf clubs 32 are in their normal positions in the golf bag 31, for example within a distance of one foot. Therefore, a typical form of the passive RFID system implementation is as shown in FIG. 4, wherein the Base Unit 51 is built into the golf bag 31 as a feature of the golf bag 31, instead of being a separate unit that is attached to the golf bag 31. Then the antenna 61 connected to the RFID reader is embedded in or near the bottom surface of the golf bag 31, such that the Peripheral Units 13 rest very close to the antenna 61 when the clubs 32 are in the bag 30, for example within a distance of one foot.

In another embodiment, the Polling Timer is implemented in the Processing Segment 20 of each Peripheral Unit 12, and according to the Polling Timer, each Peripheral Unit 12 periodically transmits a signal encoded with the identifier code stored in the memory 22 of the Peripheral Unit 12. The Base Unit 50 will receive such a signal from a Peripheral Unit 12 if the associated golf club 32 is in the golf bag 30 or in close proximity to the golf bag 30. Thus the Base Unit 50 may use a similar processing method as that described above and shown in FIG. 5 to obtain inventories of golf clubs 32 and detect when one has been misplaced and activate an alarm 64 appropriately. In this embodiment, the Base Unit 50 may or may not include an RF transmitter, and each Peripheral Unit 12 may or may not include an RF receiver.

In another embodiment, each Peripheral Unit 12 contains a light sensor. There is generally a low-light environment inside of a golf bag relative to the environment outside of the bag. In this embodiment, when a golf club 32 fitted with a Peripheral Unit 12 is removed from the golf bag 30, the light sensor on the Peripheral Unit 12 receives an increased light intensity as compared to the light intensity it received while in the bag 30. When the received light intensity transitions from low to high across a predetermined threshold intensity value, the Processing Segment 20 of the Peripheral Unit 12 forms a signal encoded with the identifier code stored in the memory 22 of the Peripheral Unit 12 and an indication that the associated golf club is out of the bag 30, and the transmitter 16 of the Peripheral Unit 12 transmits this signal. In this embodiment, when a golf club 32 fitted with a Peripheral Unit 12 is returned to the golf bag 30, the light sensor on the Peripheral Unit 12 receives a decreased light intensity. When the received light intensity transitions from high to low across the predetermined threshold intensity value, the Processing Segment 20 of the Peripheral Unit 12 forms a signal encoded with the identifier code stored in the memory 22 of the Peripheral Unit 12 and an indication that the associated golf club is in the bag 30, and the transmitter 16 of the Peripheral Unit 12 transmits this signal. In this embodiment, the receiver 66 of the Base Unit 50 receives those signals, and the processing method in the Base Unit 50 uses the signals as inputs regarding which clubs 32 have been removed from and returned to the golf bag 30. In this embodiment, the method does not use polling, and does not compare inventories to previous inventories. However, other elements of the processing method employed by this embodiment are similar to those of the processing method described above and shown in FIG. 5. In this embodiment, the Base Unit 50 may or may not include an RF transmitter, and each Peripheral Unit 12 may or may not include an RF receiver.

In FIG. 2, the attachment manner for the Base Unit 50 is provided by a feature 52 that hooks or clips to the top or side of the golf bag 30. Possible variations of this embodiment include location of the Base Unit 50 in a pocket of the golf bag 30, or in or on a golf cart, or in some other location in close proximity to the golf bag 30. In an embodiment wherein the Base Unit 50 is located in or on the golf cart, the Base Unit 50 may be attached to the cart via suction cup, clamp, magnet or some other attachment manner known in the art. It may be desirable to locate and attach the Base Unit 50 in a manner that gives a minimally obstructed line-of-sight between the Base Unit 50 and the Peripheral Units 12 when the golf clubs 32 are in the golf bag 30, and/or maintains some orientation that facilitates optimal RF transmission between the Base Unit 50 and the Peripheral Units 12.

In addition to components described heretofore, the Base Unit 50 may include any or all of the following: a means of powering on and off; a means of resetting its processing method; a protective housing or enclosure; selectable varieties of alert modes for the alarm 64; a display device 54 for displaying various system information; a key pad 56, buttons, or other means of setting various variables or other parameters of the processing method and otherwise controlling the functionality of the system. The Base Unit 50 may have as a power source a rechargeable battery, and in this case, the Base Unit 50 may include components to allow connection to an external electrical power source for charging of that battery. The Peripheral Units 12 may have as power sources rechargeable batteries, and in this case, the Base Unit 50 may include components to allow connection to the Peripheral Units 12 and to an external electrical power source for charging of those batteries.

The electrical power sources for the Base Unit 50 and/or Peripheral Units 12 may comprise photo-voltaic cell arrays, and/or batteries of some type that are charged and/or augmented by photo-voltaic cell arrays.

The Base Unit 50 may be electrically powered on and off via an automatic method requiring no user input, controlled by the Processing Segment 60 of the Base Unit 50, and employing a light sensor and/or a motion sensor included in the Base Unit 50.

The Base Unit 50 may include a selection means such as a key pad 56 that allows the user to select the durations of the Max Timers, and/or the Polling Timer, and/or the Removal Timer, and/or the Return Timer.

The Base Unit 50 may include a display device 54 that is a Liquid Crystal Display (LCD), or an Organic Light-Emitting Diode (OLED) display.

The Base Unit 50 may include a display device 54 that indicates the number of clubs 32 that are currently out of the bag 30 or in use, the state of charge of its internal battery 58, and may include an alert mechanism that indicates a low state of charge of its internal battery 58.

The Base Unit 50 may include a display device 54 that indicates the state of charge of the batteries 24 in the Peripheral Units 12, and may include an alert mechanism that indicates a low state of charge of one or more batteries 24 of the Peripheral Units 12. In this embodiment, each Peripheral Unit 12 includes information regarding its battery's state of charge as part of the RF signals that it transmits to the Base Unit 50.

Further, each Peripheral Unit 12 may be built in to a special golf club grip, where the manner of attaching the Peripheral Unit 12 to a golf club is to attach that special grip to the golf club.

Further still, each Peripheral Unit 12 may include a light emitting diode (LED) or some other alert mechanism that indicates a low state of charge of its internal battery 24.

VII. Additional Functionality of the System

In one embodiment, the system as purchased may comprise a Base Unit 50 and a plurality of Peripheral Units 12, for example three Peripheral Units 12. The memory 22 within each Peripheral Unit 12 contains a unique digital identifier code, which is pre-programmed during manufacture. The memory 62 within the Base Unit 50 is pre-programmed during manufacture with all of the unique identifier codes that are contained in the Peripheral Units 12 of the system.

In an embodiment, the digital identifier code contained in the memory 22 of a Peripheral Unit 12 is also physically printed or in some other manner indicated during manufacture on the body of the Peripheral Unit 12 so that it is visible and readable by the user. This indication of the identifier code on the Peripheral Unit 12 may be helpful to the user in various situations. For example, if the battery 24 in a Peripheral Unit 12 has a lower than desirable voltage level, this information may be encoded into a signal sent from the Peripheral Unit 12 to the Base Unit 50. Then the Base Unit 50 may display or in some other manner communicate this information to the user, so that the user will know to replace the battery 24 in that Peripheral Unit 12. For example, the Base Unit 50 may display this information on an LCD-type display device, or on an LED-type display device. The Base Unit 50 may display the identifier code of the Peripheral Unit 12 that has the battery 24 with lower than desirable voltage level. Then, having seen the identifier code displayed by the Base Unit 50, the user may find the corresponding Peripheral Unit 12 by examining the printed identifier codes on the Peripheral Units 12. Then, having found the Peripheral Unit 12 with the same identifier code displayed by the Base Unit 50, the user may replace the battery 24 of that Peripheral Unit 12.

Additionally, it may be desirable for the user to know which Peripheral Unit 12 identifier codes are stored in the Base Unit 50. In this example, the user may use a key pad 56 to activate a mode of the Base Unit 50 whereby it displays the identifier codes that are stored in its memory 62. Then the user may check the printed identifier codes on the Peripheral Units 12 to see if they are the same or different as the identifier codes displayed by the Base Unit 50.

Additionally, it may be desirable for the user to know which Peripheral Units 12 are currently detected by the Base Unit 50 to be in close proximity to the Base Unit 50. In this example, the user may use a key pad 56 to activate a mode of the Base Unit 50 whereby it displays the identifier codes of the Peripheral Units 12 that are currently detected by the Base Unit 50 to be in close proximity to the Base Unit 50. Then the user may check the printed identifier codes on the Peripheral Units 12 to see if they are the same or different as the identifier codes displayed by the Base Unit 50.

A user may wish to add Peripheral Units 12 to a system in addition to the Peripheral Units 12 that were included with the system as purchased. Peripheral Units 12 may be sold separately. In an embodiment, the memory 22 within each separately sold Peripheral Unit 12 contains a unique digital identifier code, which is pre-programmed during manufacture. When purchasing additional Peripheral Units 12, the user may check the identifier codes printed on their bodies or otherwise indicated, to ensure that the identifier code of any of those Peripheral Units 12 does not match the identifier code of any Peripheral Unit 12 included in the original system. However, even if the user does not perform such a check, it is very unlikely that such a match will occur due to the high number of possible identifier codes. For example, in an embodiment, the identifier code comprises three bytes of data, such that there are over 16 million (exactly 16,777,216) possible identifier codes. In an embodiment, it is desirable that no two Peripheral Units 12 in the same system have matching identifier codes, so that all Peripheral Units 12 in a system may be distinguished from each other by the Processing Segment 60 of the Base Unit 50 of that system.

In an embodiment, when a user adds Peripheral Units 12 to a system in addition to the Peripheral Units 12 that were included with the system as purchased, there is a method of adding the identifier codes associated with the additional Peripheral Units 12 to the memory of the Base Unit 50. The user may read the identifier code printed on each additional Peripheral Unit 12 and then manually enter that identifier code into the Base Unit 50 along with a command to add it to memory 62, via buttons or some other input device of the Base Unit 50. Also there may be a more automated method by which to add the identifier codes associated with the additional Peripheral Units 12 to the memory 62 of the Base Unit 50, as follows: the user places the Peripheral Units 12 to be added in close proximity to the Base Unit 50; the user sets the Base Unit 50 in a "Learn" mode via buttons or some other input device of the Base Unit 50; the Base Unit 50 then transmits a first RF signal encoded in such a way as to cause any Peripheral Unit 12 that receives this first signal to transmit a second RF signal encoded with its identifier code. In an embodiment in this case, the first signal is encoded in such a way that upon receiving it from the Base Unit 50, the AFE of the Peripheral Unit 12 activates the microcontroller 21 of the Peripheral Unit 12, taking it out of sleep mode; then the AFE passes the demodulated data of the first signal to the microcontroller 21 for processing, whereupon the Processing Segment 20 of the Peripheral Unit 12 forms the second signal encoded with the identifier code of the Peripheral Unit 12, and passes the second signal to the transmitter 16 of the Peripheral Unit 12, which transmits the second signal.

In this embodiment, the Processing Segment 20 in the Peripheral Unit 12 controls the transmission of the second signal such that there is some brief delay between the time the first signal is received by the Peripheral Unit 12 and the time that the second signal is transmitted by the Peripheral Unit 12. The duration of this delay may be a function of the identifier code in the Peripheral Unit 12 and thereby will be different for each Peripheral Unit 12. The purpose of such different delays is to prevent so-called data collisions, that is, to prevent multiple Peripheral Units 12 from sending their second signals simultaneously. The delays thereby increase the likelihood that each individual second signal will be received separately by the Base Unit 50 and processed by the Processing Segment 60 of the Base Unit 50.

During Learn mode, when the Base Unit 50 receives a signal from a Peripheral Unit 12, if the Processing Segment 60 of the Base Unit 50 detects that the identifier code encoded in the signal is not already included in the group of identifier codes contained in the memory 62 of the Base Unit 50, the Processing Segment 60 of the Base Unit 50 adds that identifier code to the group. In an embodiment, after a predetermined amount of time has elapsed in Learn mode, the Base Unit 50 displays the total number of identifier codes stored in its memory 62. If this displayed number is less than the total number of Peripheral Units 12 in the system, it may indicate to the user that all the identifier codes of the additional Peripheral Units 12 were not added to the memory 62 of the Base Unit 50, and in this case, the user may set the Base Unit 50 in Learn mode again one or more times, until the number displayed by the Base Unit 50 after an instance of Learn mode is equal to the total number of Peripheral Units 12 in the system.

A user may wish to remove Peripheral Units 12 from a system, perhaps to give them to someone else, or for some other reason. In an embodiment, there is a method of removing the identifier codes associated with particular Peripheral Units 12 from the memory 62 of the Base Unit 50. The user may read the identifier code printed on each Peripheral Unit 12 to be removed and then manually enter that identifier code into the Base Unit 50 along with a command to remove it from memory 62, via buttons or some other input device of the Base Unit 50. Also there may be a more automated method by which to remove from the memory 62 of the Base Unit 50 the identifier codes associated with particular Peripheral Units 12, as follows: the user places the Peripheral Units 12 to be removed in close proximity to the Base Unit 50; the user sets the Base Unit 50 in a "Unlearn" mode via buttons or some other input device of the Base Unit 50; the Base Unit 50 sends a first signal and each Peripheral Unit 12 in close proximity responds with a second signal, in the same manner as occurs for the Learn mode described above. However, in Unlearn mode, when the Base Unit 50 receives a second signal from a Peripheral Unit 12, if the Processing Segment 60 of the Base Unit 50 detects that the identifier code encoded in the signal is included in the group of identifier codes contained in the memory 62 of the Base Unit 50, the Processing Segment 60 of the Base Unit 50 removes that identifier code from the group. In an embodiment, after a predetermined amount of time has elapsed in Unlearn mode, the Base Unit 50 displays the total number of identifier codes stored in its memory 62. If this displayed number is greater than the total desired number of Peripheral Units 12 in the system, it may indicate to the user that all the identifier codes of the particular Peripheral Units 12 to be removed were not in fact removed from the memory 62 of the Base Unit 50, and in this case, the user may set the Base Unit 50 in Unlearn mode again one or more times, until the number displayed by the Base Unit 50 after an instance of Unlearn mode is equal to the total desired number of Peripheral Units 12 in the system.

In an embodiment, the memory 62 of the Base Unit 50 may contain a digital identifier code associated with itself, herein to be called a Base Code, distinct from the identifier codes associated with the Peripheral Units 12, herein to be called Peripheral Codes. The memory 22 of each Peripheral Unit 12 in a particular system contains the Base Code associated with the Base Unit 50 of that system. In a system as purchased, the Base Code is pre-programmed into the memories of the Base Unit 50 and the Peripheral Units 12 during manufacture. In an embodiment, when the Base Unit 50 performs a poll, it sequentially transmits RF signals, each signal encoded with the Base Code and one of the Peripheral Codes. When a first signal transmitted by the Base Unit 50 is received by the receiver 18 of a Peripheral Unit 12, this first signal is processed by the Processing Segment 20 of the Peripheral Unit 12. If the Base Code and the Peripheral Code encoded into this first signal match the Base Code and the Peripheral Code stored in the memory 22 of the Peripheral Unit 12, the Peripheral Unit 12 transmits a second signal to be used by the Base Unit 50 in obtaining an inventory of Peripheral Units 12, as described previously in the discussion of the poll function.

In this embodiment, during Learn mode the Base Unit 50 transmits a first RF signal encoded with its Base Code and further encoded in such a way as to cause any Peripheral Unit 12 that receives this first signal to store the Base Code in its memory 22 and to transmit a second RF signal encoded with its Peripheral Code. During Unlearn mode the Base Unit 50 transmits a first RF signal encoded with its Base Code and further encoded in such a way as to cause any Peripheral Unit 12 that receives this first signal to remove the Base Code from its memory 22 and to transmit a second RF signal encoded with its Peripheral Code. Each RF signal transmitted by the Base Unit 50 to the Peripheral Units 12 is encoded with its Base Code and may be further encoded in such a way that upon a Peripheral Unit 12 receiving an RF signal from the Base Unit 50, the AFE of the Peripheral Unit 12 activates the microcontroller 21 of the Peripheral Unit 12, taking it out of sleep mode, and passes the demodulated data of the signal to the microcontroller 21 for processing, performing these steps only if the Base Code encoded in that signal matches the Base Code stored in the memory 22 of the Peripheral Unit 12.

VIII. Anti-Conflict Features for Multiple Systems in Close Proximity

It is generally desirable that multiple misplaced golf club alert systems can function properly in close proximity to each other. For example, each of two golfers may be using a misplaced golf club alert system while sharing a golf cart, such that their two golf bags typically would be positioned adjacent to each other on the back of the golf cart throughout the round of golf. More generally, a group of golfers playing together commonly comprises 4 golfers, and each one may be using a misplaced golf club alert system; in certain circumstances all 4 of their golf bags may be in close proximity. In one embodiment the radio frequencies employed by the Base Unit 50 and the Peripheral Units 12 of a system may be selectable by the user, such that golfers playing together would be able to select different frequencies than each other for their respective systems. In this case, the RF signals sent by the Base Unit 50 and Peripheral Units 12 of one system would not be processed by the Base Unit 50 and Peripheral Units 12 of the other systems, and thus there would be no conflict between the systems.

In case multiple systems operating in close proximity are using similar radio frequencies, it is still possible for them to function properly. The use of Peripheral Codes ensures that a particular Peripheral Unit 12 will only respond to a particular Base Unit 50 if they are in the same system, unless a Peripheral Unit 12 in one system has the exact same Peripheral Code as a Peripheral Unit 12 in a different system and the two systems are in close proximity. This is exceedingly unlikely, given the large number of possible Peripheral Codes, (e.g. 16,777,216 possible codes in the case of a three-byte code).

In an embodiment employing a Base Code, it is even more unlikely that a Peripheral Unit 12 will respond to a Base Unit 50 of a different system, as a Peripheral Unit 12 will only respond when it receives a signal that includes a particular Base Code and a particular Peripheral Code, where there are a large number of possible Base Codes and Peripheral Codes (e.g. 16,777,216 possible codes for each in the case of three-byte codes).

Furthermore, the Base Unit 50 may employ a method whereby if it is polling a particular Peripheral Unit 12 and does not receive a response signal, it re-sends the same polling signal one or more times in case that Peripheral Unit 12 is in close proximity to the Base Unit 50, but the initial polling signal or the response signal from the Peripheral Unit 12 was disrupted by a signal from another system in close proximity operating with the same radio frequency as the first system. Also, the Base Unit 50 may employ a method by which it can detect that an incoming signal from a Peripheral Unit 12 has been disrupted by a signal from another system in close proximity. In that case, the Base Unit 50 may have a method by which it dynamically changes the timing of its polling signals to de-synchronize itself from the conflicting system, such that the polling timing is different for the two systems, and their signals no longer interfere with or disrupt each other.

What has been described above includes examples of multiple embodiments. It is, of course, not possible to describe every conceivable combination of components or methodologies for purposes of describing the aforementioned embodiments, but one of ordinary skill in the art may recognize that many further combinations and permutations of various embodiments are possible. Accordingly, the described embodiments are intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A system for alerting a golfer when one or more golf clubs are misplaced from a group of golf clubs comprising:

a) a peripheral unit associated with each golf club of the group of golf clubs having a limited range and operative to transmit signals and detect signals throughout the limited range and a memory operative to store a unique identifier, wherein each peripheral unit associated with a golf club transmits a unique identifier;

b) a base unit having a limited range and operative to transmit signals and detect signals from each peripheral unit throughout the limited range, a memory operative to store one or more unique identifiers transmitted by the one or more peripheral units, and a processor operative to perform periodic inventories of the group of golf clubs, wherein a golf club is identified as absent from the group of golf clubs when the peripheral unit of the golf club is outside the limited range and thus its associated unique identifier is not received by the base unit, the processor further operative to compare the most recent inventory with the previous inventory to determine which golf clubs have been recently removed from the group of golf clubs or returned to the group of golf clubs, initiate a removal timer when a golf club is removed from the group of golf clubs, initiate a return timer when a golf club is returned to the group of golf clubs, and determine an absent golf club to be misplaced if and when the removal timer and the return timer have expired; and c) an alarm operative to alert the golfer when a golf club of the group of golf clubs is determined to be misplaced.

2. The system according to claim 1, wherein the system is operative by an electrical power source.

3. The system according to claim 2, wherein the power source is a battery or one or more photo-voltaic cells.

4. The system according to claim 2, wherein the electrical power source is activated by a light sensor and/or a motion sensor.

5. The system according to claim 1, wherein the base unit further comprises a key pad operative to adjust the removal timer and/or the return timer.

6. The system according to claim 1, wherein with periodicity of the inventories is controlled by a polling timer.

7. The system according to claim 6, wherein the base unit further comprises a key pad operative to adjust the polling timer.

8. The system according to claim 1, wherein the processor is further operative to initiate a maximum duration timer for each golf club removed from the group of golf clubs wherein expiration of the maximum duration timer initiates the alarm.

9. The system according to claim 8, wherein the base unit further comprises a key pad operative to adjust the maximum duration timer.

10. The system according to claim 1, wherein the system further comprises a display screen.

11. The system according to claim 10, wherein the display screen is a liquid crystal display or an organic light-emitting diode display.

12. The system according to claim 10, wherein the display screen is operative to indicate the number of golf clubs in the group of golf clubs.

13. The system according to claim 10, wherein the display screen is operative to indicate the number of golf clubs absent from the group of golf clubs.

14. The system according to claim 10, wherein the display screen is operative to indicate the remaining battery charge of the base unit and/or the remaining battery charge of the peripheral unit associated with each golf club.

15. The system according to claim 1, wherein the peripheral unit is affixed to the end of the handle of each golf club of the group of golf clubs.

16. The system according to claim 1, wherein the peripheral unit further comprises an alerting means for alerting the user that the remaining charge of the battery is low.

17. The system according to claim 16, wherein the alerting means is a light emitting diode.

18. A method for detecting one or more misplaced golf clubs from a group of golf clubs comprising:

a) periodically inventorying golf clubs in the group of golf clubs, whereby a unique identifier response is transmitted from a peripheral unit associated with each golf club;

b) storing the unique identifier received from each peripheral unit in a memory;

c) comparing the unique identifier received from each golf club during the most recent inventory to the unique identifier received from each golf club during the previous inventory to determine which golf clubs have been recently removed from the group of golf clubs or returned to the group of golf clubs;

d) monitoring a golf club that is absent from an inventory of golf clubs to determine if the absent golf club has been misplaced wherein the absent golf club is determined to be misplaced when a removal timer and a return timer have expired; and e) initiating an alert if one or more of the golf clubs are determined to be misplaced.

* * * * *